US006419336B1

(12) United States Patent
Takahashi

(10) Patent No.: US 6,419,336 B1
(45) Date of Patent: Jul. 16, 2002

(54) INK EJECTOR

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/317,996

(22) Filed: May 25, 1999

(30) Foreign Application Priority Data

May 26, 1998 (JP) ..... 10-144404

(51) Int. Cl.[7] ..... B41J 29/38
(52) U.S. Cl. ..... 347/10; 347/11; 347/15
(58) Field of Search ..... 347/10, 11, 15, 347/5

(56) References Cited

U.S. PATENT DOCUMENTS

| | | | | |
|---|---|---|---|---|
| 4,879,568 A | | 11/1989 | Bartky et al. | 347/69 |
| 4,887,100 A | | 12/1989 | Michaelis et al. | 347/69 |
| 4,992,808 A | | 2/1991 | Bartky et al. | 347/69 |
| 5,003,679 A | | 4/1991 | Bartky et al. | 29/25.35 |
| 5,028,936 A | | 7/1991 | Bartky et al. | 347/69 |
| 5,359,350 A | * | 10/1994 | Nakano et al. | 347/10 |
| 5,689,291 A | * | 11/1997 | Tence et al. | 347/10 |
| 5,980,012 A | * | 11/1999 | Fujita et al. | 347/5 |
| 6,106,092 A | * | 8/2000 | Norigoe et al. | 347/11 |
| 6,126,263 A | * | 10/2000 | Hotomi et al. | 347/15 |
| 6,134,020 A | * | 10/2000 | Masumoto et al. | 358/1.16 |

FOREIGN PATENT DOCUMENTS

| | | | | |
|---|---|---|---|---|
| EP | 0 827 838 A2 | * | 11/1998 | B41J/2/21 |
| JP | A-63-247051 | | 10/1988 | B41J/3/04 |

* cited by examiner

*Primary Examiner*—John Barlow
*Assistant Examiner*—Alfred Dudding
(74) *Attorney, Agent, or Firm*—Oliff & Berridge, PLC

(57) ABSTRACT

An ink ejector includes an ink jet head. The head has ink channels each defined between a pair of actuator walls. The head also has nozzles each communicating with one of the channels. In accordance with a print instruction, a controller applies to the appropriate actuator walls one or two ejection pulses of voltage depending on the resolution specified by the instruction. Each ejection pulse increases the volume of the associated channel once and decreases it subsequently to eject an ink droplet from the channel through the associated nozzle. In a normal resolution mode, two such ejection pulses are applied. In a first high resolution mode, one such ejection pulse is applied. In a second high resolution mode, one such ejection pulse is followed by an auxiliary pulse for making the droplet smaller. The ratio of the total volume of the two droplets in the normal resolution mode to the volume of the droplet in the first high resolution mode is approximately 2/1. The ratio of the droplet volume in the first high resolution mode to that in the second high resolution mode is approximately 2/1. This enables the difference in dot density between the resolution modes to be distinct for good printing.

20 Claims, 9 Drawing Sheets

NORMAL RESOLUTION MODE 360dpi 40~45pl

FIRST HIGH RESOLUTION MODE 720dpi 20~255pl

SECOND HIGH RESOLUTION MODE 1440dpi 10~15pl

Fig. 6

EMBODIMENT OF THE INVENTION

| | NUMBER OF DROPLETS | VOLUME OF INK (pl) | VOLUME RATIO |
|---|---|---|---|
| NORMAL RESOLUTION MODE | 2 | 40～45 | 1.89 |
| FIRST HIGH RESOLUTION MODE | 1 | 20～25 | 1.00 |
| SECOND HIGH RESOLUTION MODE | 1 | 10～15 | 0.56 |

COMPARATIVE EXPERIMENT

| | NUMBER OF DROPLETS | VOLUME OF INK (pl) | VOLUME RATIO |
|---|---|---|---|
| NORMAL RESOLUTION MODE | 1 | 30～35 | 1.44 |
| HIGH RESOLUTION MODE | 1 | 20～25 | 1.00 |

INK EJECTOR

BACKGROUND OF THE INVENTION

1. Field of the Invention

The present invention relates to an ink ejector for forming an image on a recording medium such as recording paper by ejecting ink from a number of channels in accordance with a print instruction.

2. Description of Related Art

Of all non-impact printers, ink jet printers have simple principles and can easily perform multiple gradation and colorization printing. Drop-on-demand ink jet printers eject only droplets of ink for printing. Ink jet printers of this type are coming rapidly into wide use because of high ejection efficiency and low running costs.

For example, U.S. Pat. No. 4,879,568, U.S. Pat. No. 4,887,100, U.S. Pat. No. 4,992,808, U.S. Pat. No. 5,003,679 and U.S. Pat. No. 5,028,936, which correspond to Japanese Patent Application Laid-Open No. 63-247051, disclose ink ejectors of the shear mode type for use in "drop-on-demand" printers. Each of the ejectors includes a controller and an ink jet head. The head has actuator walls of piezo-electric material, which are arranged in pairs to define channels between them. The head also has nozzles for the respective channels.

FIG. 9 of the drawings accompanying this specification shows the waveform of voltage for driving the actuator walls of one of the ejectors disclosed in the patents. The waveform includes an ejection pulse for ejecting an ink droplet from each of the associated channels and a non-ejection pulse for canceling the pressure wave vibration in the channel after the ejection. In response to the print instruction for one dot, the associated controller applies an ejection pulse and a non-ejection pulse in that order to the appropriate actuator walls to eject an ink droplet. The ejection and non-ejection pulses have predetermined widths T1 and T3, respectively.

When the ejection pulse rises, electric fields are formed in the actuator walls. The fields enlarge the channel in volume, reducing the pressure in it. Then, ink flows into the channel. In the meantime, the enlargement in volume generates a pressure wave vibration, which develops a pressure. This pressure increases, and reverses the pressure in the channel into a positive pressure, which reaches its peak about when the time T during which a pressure wave is propagated in the channel one-way elapsed after the ejection pulse rises. When this pulse falls, the volume of the channel decreases, developing a pressure, which is added to the pressure having reversed to be positive. The addition develops a relatively high pressure in that portion of the channel which is near to the associated nozzle. This pressure ejects an ink droplet from the channel through the associated nozzle.

When the pressure in the channel reverses substantially from a positive to a negative after an interval T2 from the ejection pulse, the non-ejection pulse rises. The rise of the non-ejection pulse quickly lowers the still positive pressure. When the non-ejection pulse falls, the pressure which has reversed to be negative rises quickly, canceling the pressure vibration. It is therefore possible to prevent accidental ejection of ink droplets (accidental drops), and transfer early to the process according to the next print instruction.

In accordance with the resolution mode specified by print instructions, the voltage for application to the actuator walls is changed to adjust the volume of each ink droplet so as to eject ink droplets each of the volume for the specified resolution. More specifically, the voltage for a normal resolution mode (360×360 dpi) differs from that for a high resolution mode (720×720 dpi). The voltage for the normal resolution mode may be 20 volts (E volts) so that the volume of each droplet may range between 30 and 35 picoliters. The voltage for the high resolution mode may be approximately 16 volts (about 3/4 E volts), or be 3 to 4 volts lower than that for the normal resolution mode, so that the droplet volume may range between 20 and 25 picoliters. The dot pitch is changed with the voltage.

Thus, in accordance with the specified resolution mode, the droplet volume is controlled for image formation with the desired dot density on a recording medium.

However, the ratio of the droplet volume in the normal resolution mode to that in the high resolution mode is about 10/7, and therefore the difference in droplet volume is too small. Consequently, the difference in resolution does not make a distinct difference in dot density, that is, clearness or visibility.

In order for the difference in resolution to make the difference in dot density distinct, the difference in voltage may be larger. By way of example, the voltage for the normal resolution mode maybe higher than 20 volts. The higher voltage is preferable because it raises the ejection speed or jet velocity and increases the droplet volume. However, the higher ejection speed amplifies the pressure wave vibration in each channel, amplifying the vibration of the meniscus formed at the front end of the associated nozzle. Excessive vibration of the meniscus may eject ink at wrong times or spatter ink droplets in fine particles, blurring the printing. When a meniscus is formed at the rear end of the nozzle, the associated actuator walls may piezo-electrically deform to lower the pressure in the channel for the next ejection. In this case, the meniscus recedes deep into the channel, forming air bubbles in it, which may render the ejection difficult.

On the other hand, the voltage for the high resolution mode may be lower than about 16 volts to make the droplet volume smaller for higher resolution. The lower voltage lowers the ejection speed and reduces the droplet volume. The ejector forms images while it is moved relative to a recording medium by a carriage motor (not shown). If the ejection speed is low, the ejected droplets may fly in wrong directions onto wrong spots under the influence of wind or the like. In general, while each ejected droplet is flying, it divides into a larger main drop and smaller satellites. If the ejection speed is lower, the main drop and the satellites may fly onto more displaced or dislocated spots, blurring the printing.

Thus, the difference in voltage makes only a limited difference in dot density between the resolution modes.

SUMMARY OF THE INVENTION

It is accordingly the object of the present invention to provide an ink ejector for better printing with a more distinct difference in dot density, that is, clearness or visibility.

An ink ejector according to the invention includes an ink jet head for ejecting ink. The head has an ink channel formed therein, which can be filled with ink. The head further has an ink nozzle formed therein and communicating with the channel. The head includes an actuator provided therein for changing the volume of the channel. The ejector further includes a controller for applying at least one ejection pulse of voltage to the actuator in accordance with a print instruction to control the actuator so as to eject ink from the channel through the nozzle. The print instruction includes a setting of resolution with which the ejected ink forms an image. In accordance with the setting, the controller controls the number of ejection pulses of voltage for ejecting ink droplets.

In accordance with a setting of resolution, which represents the clearness of an image to be printed, the controller can change the number of ejection pulses for application to the actuator. If the resolution specified by the user is lower, the controller increases the number of ejection pulses. This increases the frequency of driving the actuator, and therefore the number of ejected ink droplets increases. As a result, the total volume of the droplets increases, and therefore they form a larger spot or area on a recording medium. If the specified resolution is higher, the controller decreases the number of ejection pulses, decreasing the number of ejected ink droplets. Consequently, the droplets form a smaller spot for finer printing. It is therefore possible to make a distinct difference in dot density between settings of resolution.

When the resolution is set up as a first resolution, which may be a normal resolution mode, the controller applies to the actuator two ejection pulses of voltage for printing one dot. When the resolution is set up as a second resolution, which may be a high resolution, the controller applies to the actuator a single ejection pulse of voltage for printing one dot.

By the conventional method of adjusting the resolution by controlling the voltage for application to the actuators, the ratio of the volume of each ink droplet for normal resolution to that for high resolution can be only 10/7. The ejector according to the invention can increase the volume ratio up to 2/1. This makes it possible to make a distinct difference in dot density between settings of resolution. It is therefore possible to achieve printing as the users need.

The second resolution may include a high resolution and a very high (super) resolution. When the very high setting is chosen, the controller applies to the actuator the single ejection pulse for ejecting an ink droplet to print one dot and an auxiliary pulse of voltage for making the droplet smaller. When the very high setting is chosen, it is possible to eject an ink droplet smaller in volume than when the high setting is chosen. This can provide higher resolution as the users prefer and more scope or room for choice of resolution.

After applying the ejection pulse or pulses or the auxiliary pulse to the actuator, the controller may apply to the actuator a non-ejection pulse for varying the volume of the channel to cancel the pressure wave vibration in the channel. The non-ejection pulse prevents the ink head from unintentionally ejecting the ink. Therefore, without waiting until the pressure wave in the channel damps, the controller can quickly apply to the actuator the ejection pulse or pulses for printing the next dot. As a result, it is possible to improve the printing speed.

In this specification, the cancellation of the pressure wave vibration in the channel means not only damping the vibration completely, but also damping it to such a degree that no ink can be ejected.

The non-ejection pulse may have a width between 0.3T and 0.7T or between 1.3T and 1.8T where T is the one-way propagation time which it takes for the pressure wave in the channel to be propagated one way.

The two ejection pulses for printing one dot are a first pulse and a second pulse following the first pulse. The first pulse may have a width between 0.5T and 1.5T. The interval between the first and second pulses, which corresponds to an interval between a falling point (trailing edge) of the first pulse and a rising point (leading edge) of the second pulse may be 0.3T or longer. The second pulse may have a width which is 0.3T or longer. The sum of the interval and the width of the second pulse may range between 1.3T and 1.7T.

The single ejection pulse for printing one dot may have a width between 0.5T and 1.5T.

The controller may include a pulse control circuit. This circuit may include a data receiver, a memory, a processing unit and a pulse generator.

BRIEF DESCRIPTION OF THE DRAWINGS

A preferred embodiment of the invention is described with reference to the accompanying drawings, in which:

FIG. 6 is tables showing the volume of ink ejected by this ejector and the volume of ink ejected by a conventional ink ejector;

DETAILED DESCRIPTION OF A PREFERRED EMBODIMENT

Figure 7A:
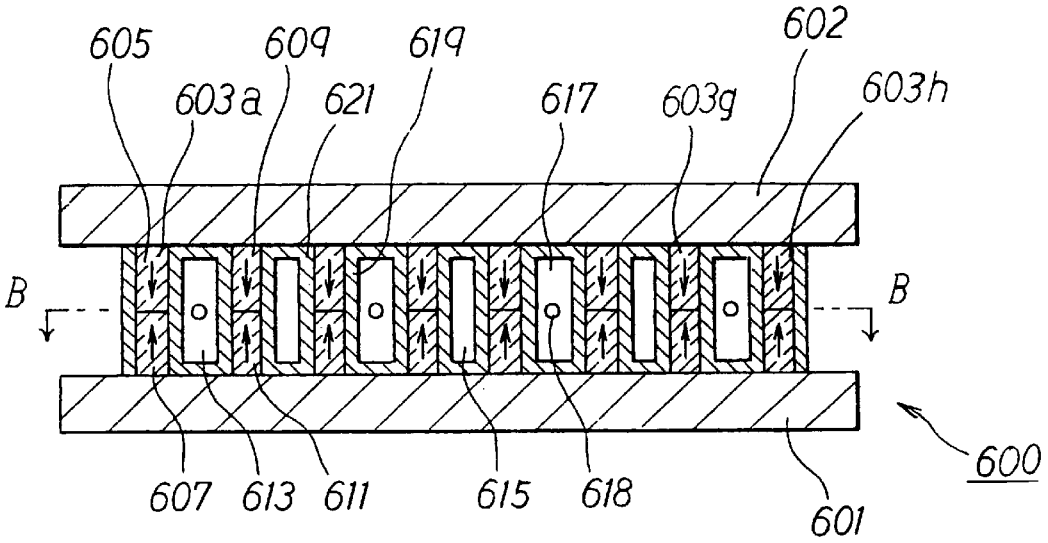
FIG. 7A is a cross section of the ejector to which the invention is applied, and is taken on the line A—A of FIG. 7B.
Figure 7B:
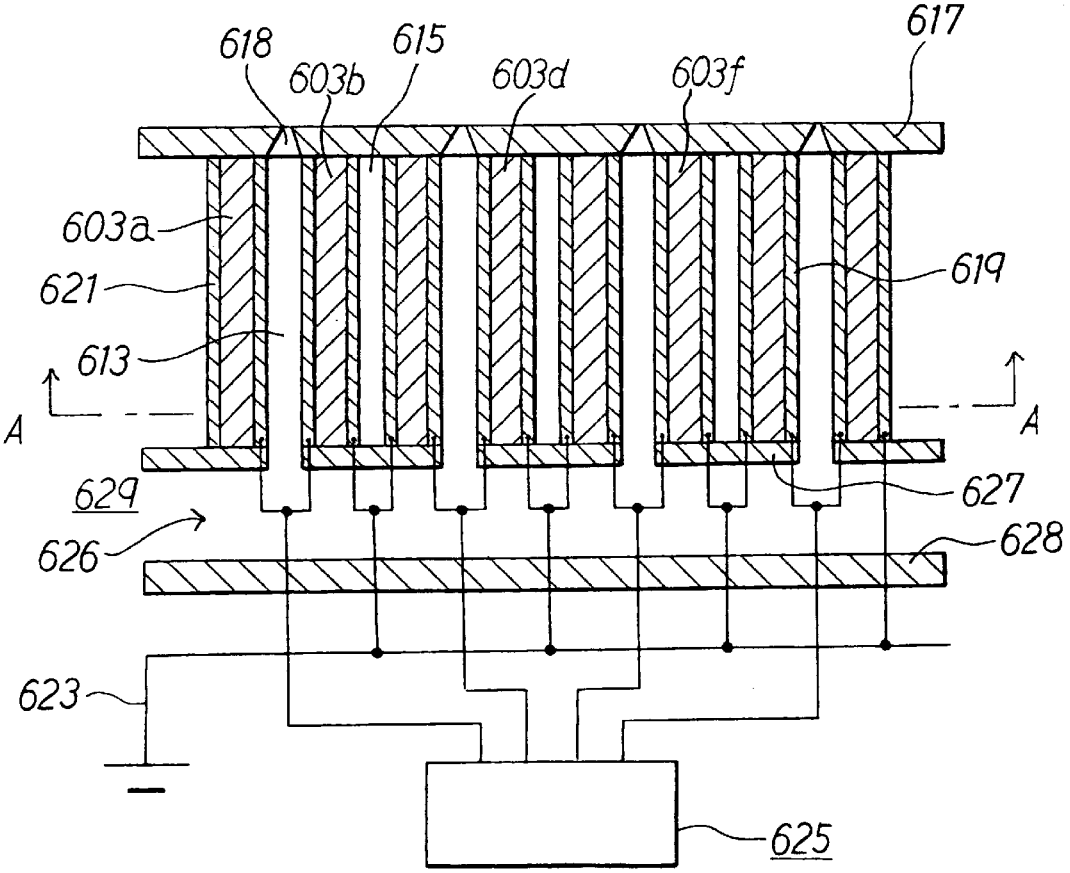
FIG. 7B is a cross section taken on the line B—B of FIG. 7A.

With reference to FIGS. 7A and 7B, an ink ejector 600 embodying the invention includes a base wall 601 and a top wall 602, between which eight shear mode actuator walls 603*a*–603*h* extend. The actuator walls 603*a*–603*h* each consist of an upper part 605 and a lower part 607, which are made of piezo-electric material. The wall parts 605 and 607 are bonded to the top wall 602 and the base wall 601, respectively, and polarized in the opposite directions of arrows 609 and 611, respectively. The actuator walls 603*a*, 603*c*, 603*e* and 603*g* pair with the actuator walls 603*b*, 603*d*, 603*f* and 603*h*, respectively, to define a channel 613 between each pair of actuator walls. The actuator walls 603*b*, 603*d* and 603*f* pair with the actuator walls 603*c*, 603*e* and 603*g*, respectively, to define a space 615 between each pair of actuator walls. The three spaces 615 are narrower than the four channels 613.

At one end of the channels 613 is secured a nozzle plate 617 formed with nozzles 618 each communicating with one of the channels. The other ends of the channels 613 are connected through a manifold 626 to an ink supply (not shown). The manifold 626 includes a front wall 627 and a rear wall 628. These walls 627 and 628, part of the top wall 602 and part of the base wall 601 define a chamber 629. The front wall 627 is formed with holes each communicating with one of the channels 613. Ink can be supplied from the supply to the chamber 629, and then be distributed to the channels 613.

The longer four sides of each channel 613 are lined with an electrode 619. The longer four sides of each space 615 are lined with an electrode 621. The outer sides of the actuator walls 603*a* and 603*h* at both ends are each lined with an electrode 621. The electrodes 619 and 621 take the form of metallized layers. The electrode 619 in each channel 613 is passivated with an insulating layer (not shown) for insulation from ink. The electrodes 619 in the channels 613 are connected to a controller 625 for applying voltage from an electric source (not shown) to these electrodes. The controller 625 is provided in or on the ejector 600. The other electrodes 621 are connected to a common ground return 623.

Figure 8:
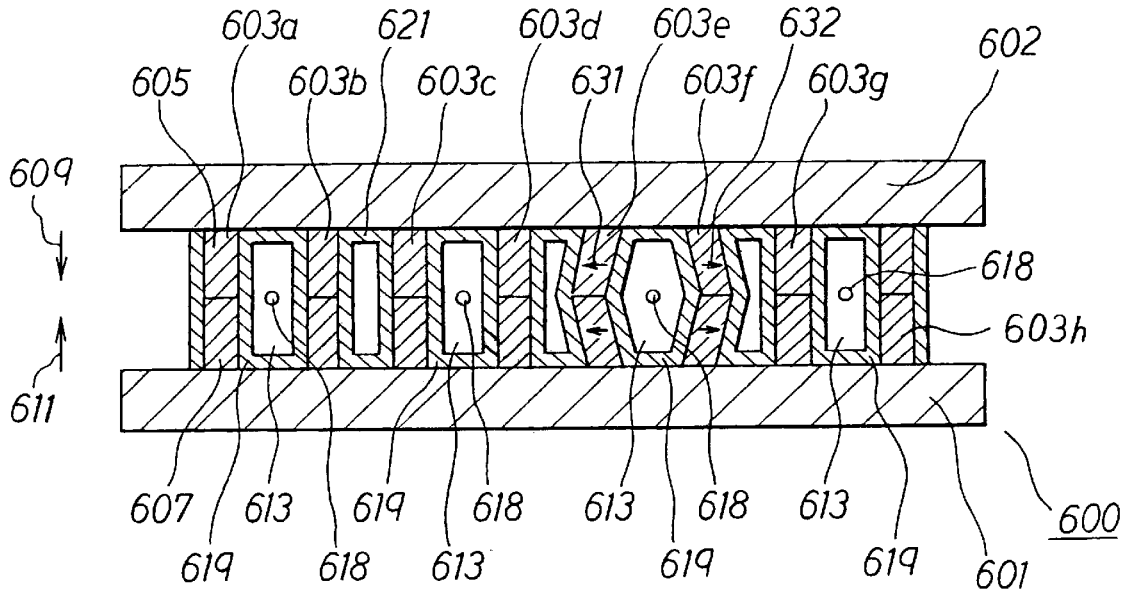
FIG. 8 is a cross section similar to FIG. 7A, but showing the operation of the ejector.
Figure 9:
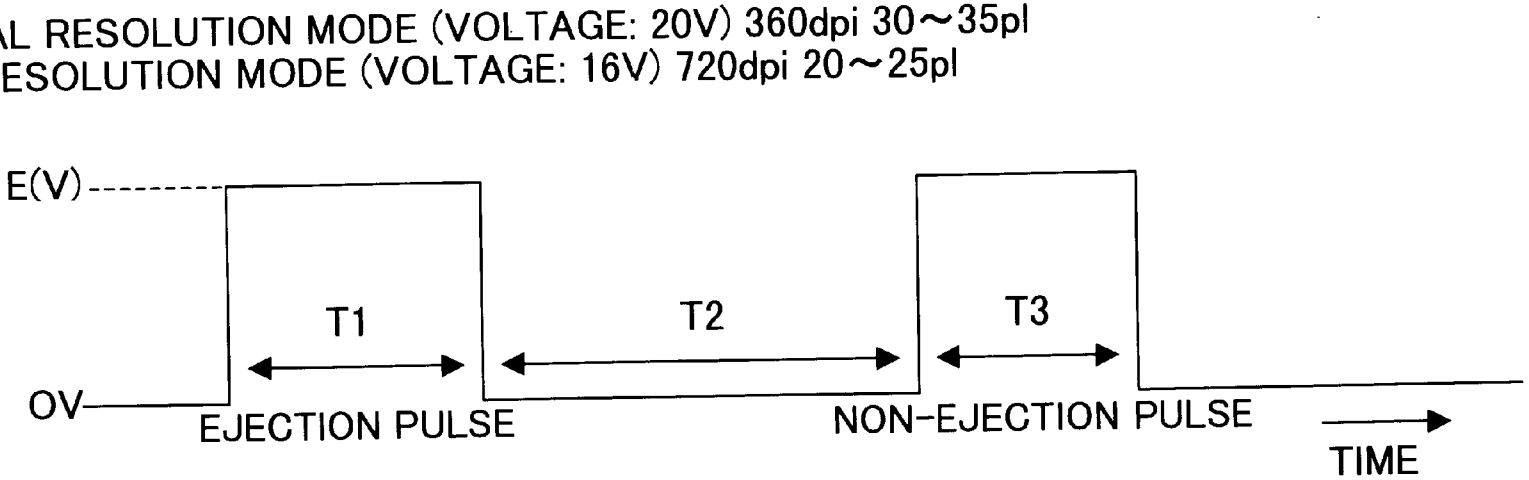
FIG. 9 is an illustration showing the drive waveform output from the controller of the conventional ejector.

In operation, the voltage applied to the electrode 619 in each channel 613 causes the associated actuator walls to deform piezo-electrically in such directions that the channel enlarges in volume. If, as shown in FIG. 8, a voltage of E volts is applied to the electrode 619 between the actuator walls 603*e* and 603*f*, for instance, electric fields are generated in these walls in the opposite directions of arrows 631 and 632. This deforms the walls 603*e* and 603*f* piezo-electrically in such directions that the associated channel 613 enlarges, reducing the pressure in this channel to a negative pressure.

The voltage applied to the electrode 619 is held for a period L/V where L is the channel length and V is the sound velocity (the velocity of the acoustic pressure wave) in the ink in the channel 613. While the voltage is applied, ink is supplied to the channel 613. The period L/V is the one-way propagation time T which it takes for the pressure wave in the channel 613 to be propagated one way longitudinally of the channel.

According to the theory of pressure wave propagation, the negative pressure in the channel 613 reverses into a positive pressure when the period L/V passes after the voltage is applied to the electrode 619. When the pressure becomes positive, the voltage is returned to zero volt. This allows the deformed actuator walls 603*e* and 603*f* to return to their original condition (FIGS. 7A and 7B), generating a positive pressure in the channel 613. This pressure is added to the pressure which has reversed to be positive reversed to be positive. As a result, a relatively high pressure develops in that portion of the channel 613 which is near to the associated nozzle 618, ejecting ink out through the nozzle.

The ejector 600 is mounted on a carriage (not shown) for moving along a platen (not shown).

Each channel 613 has a length L of 7.5 millimeters. Each nozzle 618 has a length of 100 microns (micrometers), a diameter of 40 microns at its front end and a diameter of 72 microns at its rear end. The space between the outer side of the nozzle plate 617 and the recording medium on the platen is 1–2millimeters.

Figure 1:
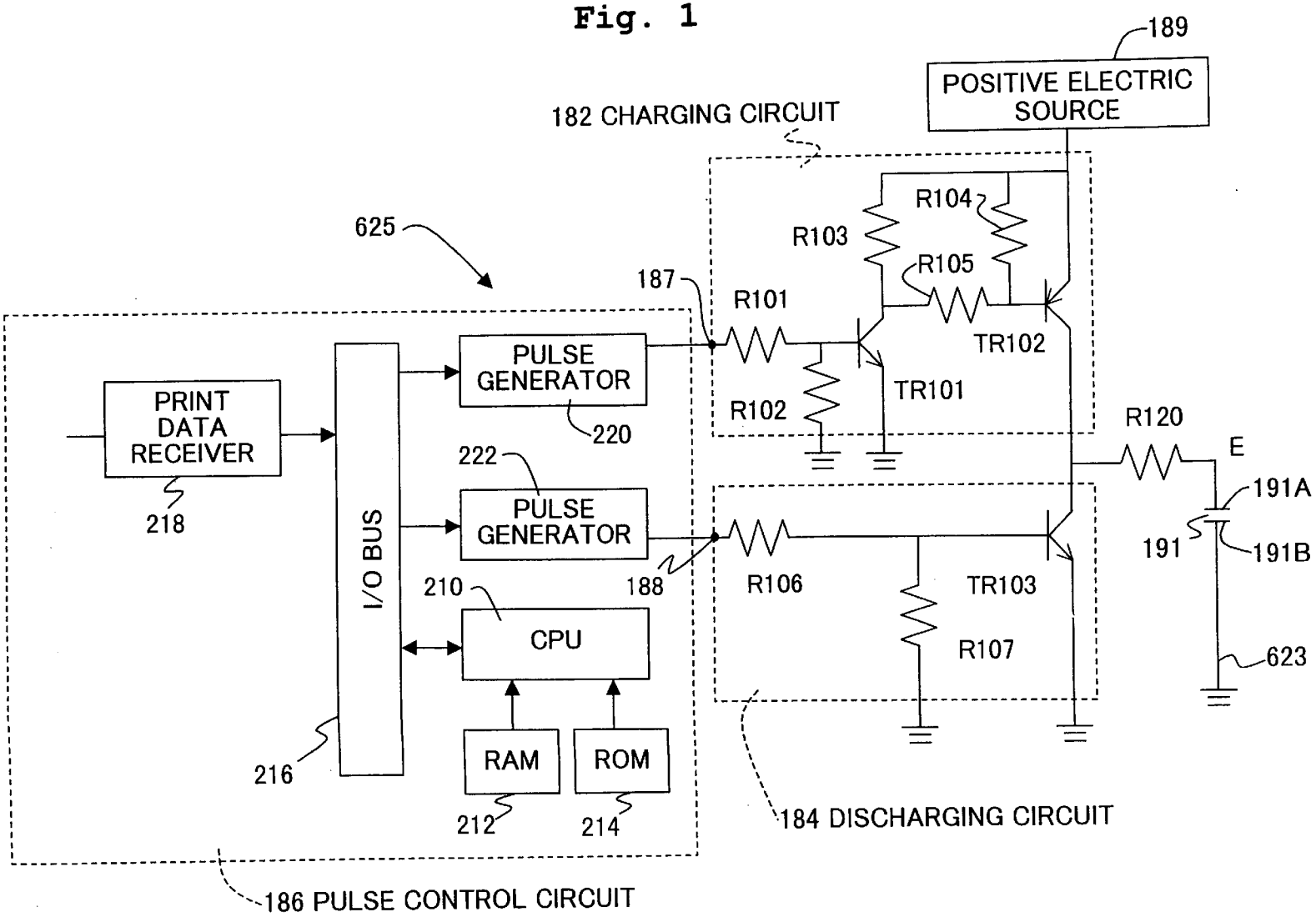
FIG. 1 is a block/circuit diagram of the controller of an ink ejector to which the invention is applied.

With reference to FIG. 1, the controller 625 includes a pulse control circuit 186, four charging circuits 182 (only one shown) and four discharging circuits 184 (only one shown). Four capacitors 191 (only one shown) represent the piezoelectric materials of the actuator walls 603*a*–603*h* and the electrodes 619 and 621 of this ejector. The capacitors 191 have terminals 191A and 191B, which correspond to the electrodes 619 and 621, respectively. The terminals 191A and 191B are connected to the controller 625 and the ground return 623, respectively.

Each charging circuit 182 has an input terminal 187, through which this circuit can receive from the pulse control circuit 186 a signal for application of a voltage of E volts to one of the capacitor terminals 191A (electrodes 619 in the channels 613). This voltage may be 16 volts. Each discharging circuit 184 has an input terminal 188, through which this circuit can receive from the control circuit 186 a signal for application of no voltage (0 volt) to one of the terminals 191A.

Each charging circuit 182 includes transistors TR101 and TR102. The base of the transistor TR101 is connected to the associated input terminal 187 through a resistor R101 and grounded through a resistor R102. The emitter of the transistor TR101 is grounded directly, and the collector of this transistor is connected to a common positive electric source 189 of E volts through a resistor R103. The base of the transistor TR102 is connected to the source 189 through a resistor R104, and to the collector of the transistor TR101 through a resistor R105. The emitter of the transistor TR102 is connected directly to the source 189, and the collector of this transistor is connected to the associated capacitor terminal 191A through a resistor R120.

If an ON signal (+5 volts) is input to the input terminal 187, the transistor TR101 becomes conductive, allowing current from the positive electric source 189 to flow from the collector of this transistor to the emitter of the transistor. This raises the voltages applied to the resistor R105 and the resistor R104, which is connected to the source 189. Consequently, the current flowing into the base of the transistor TR102 increases, making this transistor conductive between its emitter and collector. As a result, the voltage of E volts is applied from the source 189 through the emitter and the collector of the transistor TR102, and through the resistor R120, to the capacitor terminal 191A.

Each discharging circuit 184 includes a transistor TR103, the base of which is connected to the associated input terminal 188 through a resistor R106 and grounded through a resistor R107. The emitter of the transistor TR103 is grounded directly, and the collector of this transistor is connected to the associated capacitor terminal 191A through the resistor R120 associated with this terminal.

If an ON signal (+5 volts) is input to the input terminal 188, the transistor TR103 becomes conductive, grounding the capacitor terminal 191A through the resistor R120.

In accordance with the print instruction for a dot in a normal resolution mode, the following signals are input to the input terminals 187 and 188 of the associated charging and discharging circuits 182 and 184, respectively, and the voltage applied to the associated capacitor 191 by these circuits 182 and 184 varies as follows.

Figure 2:
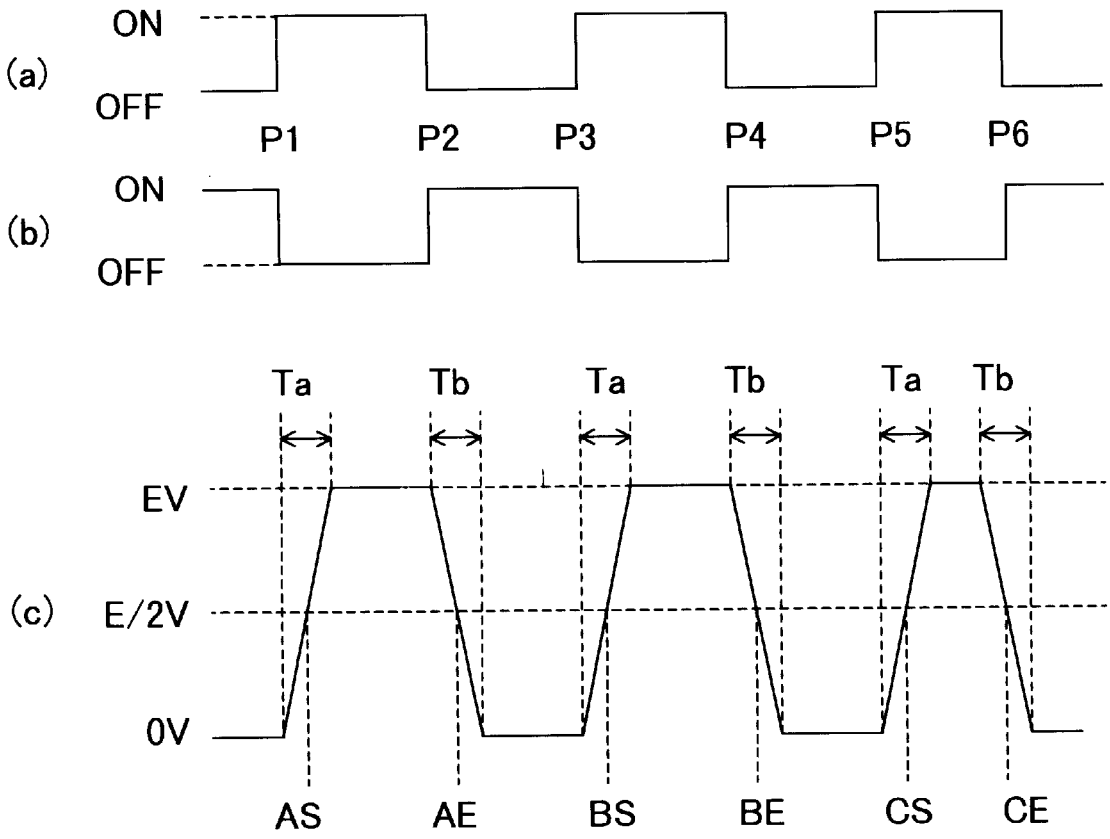
FIG. 2 is a timing chart showing the operations of the charging and discharging circuits of the controller.

As shown at (A) in FIG. 2, the signal input to the input terminal 187 of the charging circuit 182 is normally off. For ejection of ink droplets, the input signal becomes on at a point of time P1, off at a point of time P2, on at a point of time P3, off at a point of time P4, on at a point of time P5 and off at a point of time P6. As shown at (B) in FIG. 2, the signal input to the input terminal 188 of the discharging circuit 184 becomes off at the points P1, P3 and P5, and on at the points P2, P4 and P6.

In this case, as shown at (C) in FIG. 2, the voltage applied to the terminal 191A of the capacitor 191 is held normally at 0 volt. This voltage becomes E volts when a charging time Ta passes after the capacitor 191 starts charging at the point P1. The time Ta depends on the transistor TR102, the resistor R120 and the electric capacity of the actuator walls, which are shear mode type piezo-electric elements, corresponding to the capacitor 191. The voltage becomes 0 volt when a discharging time Tb passes after the capacitor 191 starts discharging at the point P2. The time Tb depends on the transistor TR103, the resistor R120 and the actuator wall capacity.

In this way, the drive waveform of voltage applied actually to the capacitor terminal 191A (electrode 619) is delayed by the time Ta and the time Tb when it rises and falls, respectively. Therefore, the points of time when the applied voltage is E/2 volts, which may be 8V, are defined as its approximate rising points AS, BS and CS and its approximate falling points AE, BE and CE. In order to time these rising and falling points suitably as stated later, the pulse control circuit 186 controls the points of time P1–P6 of the signals input to the input terminals 187 and 188.

Back to FIG. 1, the pulse control circuit 186 includes a CPU 210 for various operations, which is connected to a RAM 212 and a ROM 214. The RAM 212 stores print data and other data in it. The ROM 214 stores in it the control program for the control circuit 186 and the sequence data for generation of ON and OFF signals at the points of time P1–P6.

Figure 3:
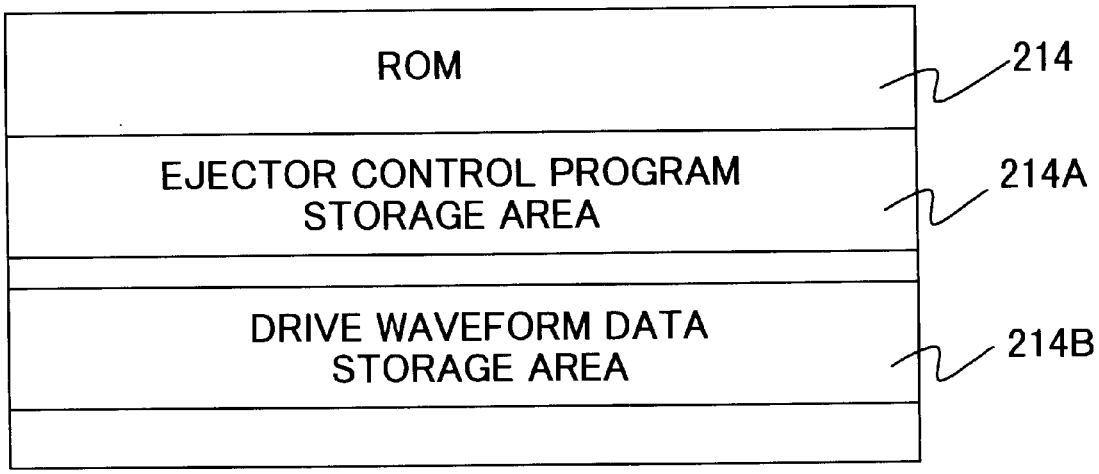
FIG. 3 is an illustration showing the structure of the ROM of the controller.

As shown in FIG. 3, the ROM 214 includes an ejector control program storage area 214A and a drive waveform data storage area 214B. Stored in the area 214B are the sequence data relating to the drive waveforms for the normal resolution mode, a first (conventional) high resolution mode and a second high resolution mode (1440×720 dpi).

The CPU 210 is connected to an I/O bus 216 via which various data can be input and output. The bus 216 is connected to a print data (print instruction) receiver 218, four first pulse generators 220 (only one shown) and four second pulse generators 222 (only one shown). The output terminal of each first pulse generator 220 is connected to the input terminal 187 of one of the charging circuits 182. The output terminal of each second pulse generator 222 is connected to the input terminal 188 of one of the discharging circuits 184.

In accordance with the sequence data stored in the area 214B of the ROM 214, the CPU 210 controls the pulse generators 220 and 222. Stored in advance in this area 214B are patterns of the points P1–Pn (n is 2 or a larger even number) for the respective resolution modes. This makes it possible to, in accordance with the print instruction for one dot, apply to the appropriate actuator walls a drive waveform of voltage for the resolution mode specified by the instruction. The CPU 210 causes the waveform to be applied to the actuator walls to eject ink from the associated channel 613.

Figure 4:
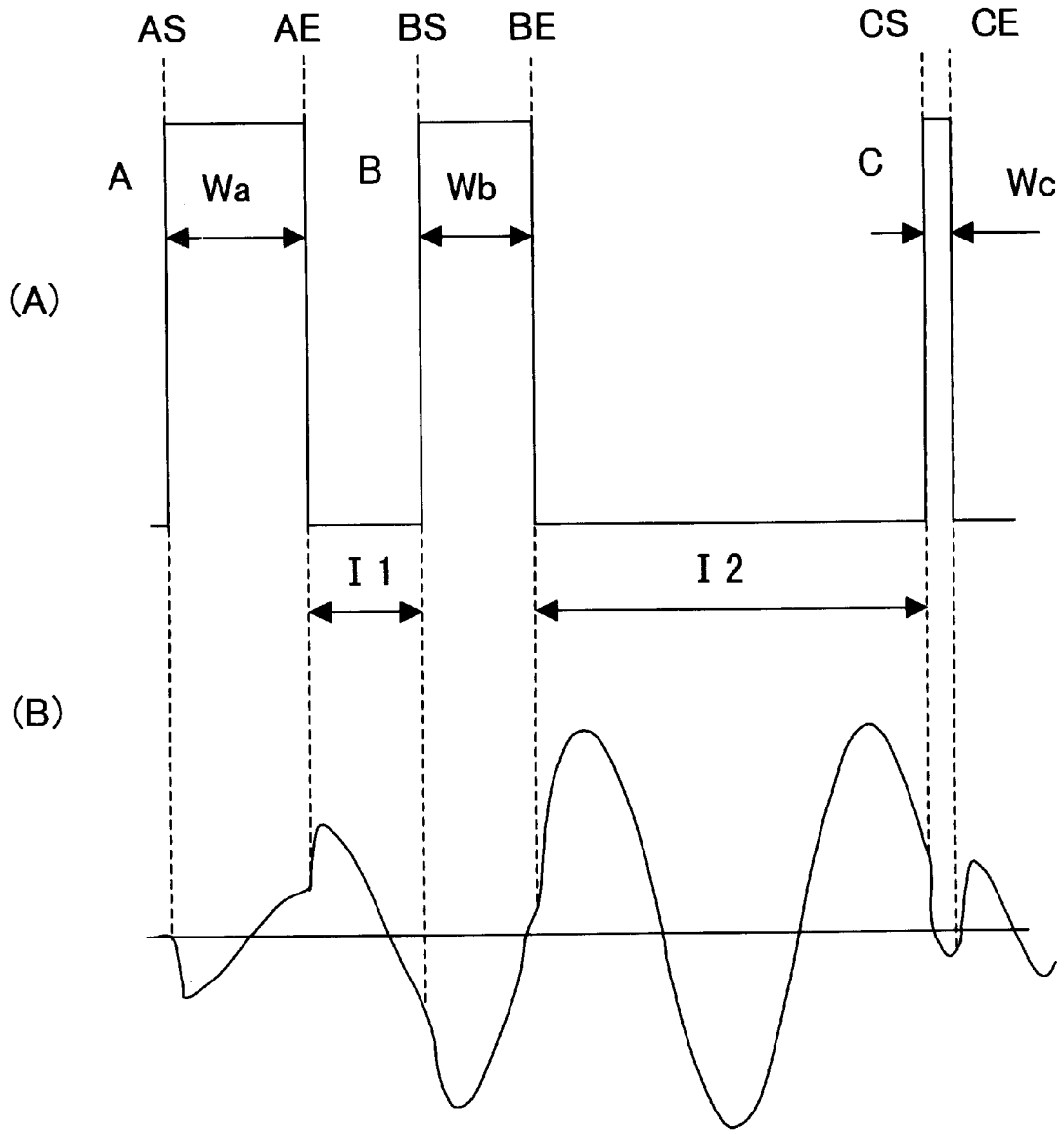
FIG. 4 is an illustration showing a drive waveform output from the controller and the pressure wave vibration generated in response to the waveform.

(A) in FIG. 4 shows an approximate drive waveform of voltage for application to the actuator walls 603*a*–603*h* in the normal resolution mode. (B) in FIG. 4 shows the pressure wave vibration generated in accordance with this waveform in each channel 613. As shown at (A) in FIG. 4, the waveform includes two ejection pulses A and B for ejection of two ink droplets and a non-ejection pulse C for cancellation of the pressure wave vibration remaining in each channel 613. The peak (voltage) values of the pulses A–C are E volts.

When the first ejection pulse A rises at a point of time AS, electric fields are generated in the appropriate actuator walls (603*e* and 603*f* in FIG. 8). The fields enlarge the volume of the associated channel 613, reducing the pressure in the channel, which includes the vicinity of the associated nozzle 618. Then, ink flows into the channel 613. In the meantime, the volume enlargement generates a pressure wave vibration, which develops a pressure. This pressure rises and reverses the pressure in the channel 613 into a positive pressure, which reaches its peak when the one-way propagation time T passes after the point AS. The pulse A falls at a point of time AE near the pressure peak, reducing the volume of the channel 613. The reduced volume generates a pressure, which is added to the positive pressure. The addition generates a relatively high pressure in that portion of the channel 613 which is near to the nozzle 618. This pressure ejects an ink droplet from the channel 613 through the nozzle 618.

Subsequently, after the positive pressure in the channel 613 reverses into a negative pressure, the second ejection pulse B rises at a point of time BS. This pulse B falls at a point of time BE near the point when the one-way propagation time T passes after the rising point BS. This ejects another ink droplet likewise from the channel 613.

While the carriage is moving relative to the recording paper, the two ink droplets are ejected onto slightly displaced or dislocated points on the paper and stick to it.

Thereafter, before the pressure in the channel 613 reverses from a positive to a negative, the non-ejection pulse C rises at a point of time CS. After the pressure becomes negative, this pulse C falls at a point of time CE. At the rising point CS, the still positive pressure lowers rapidly. At the falling point CE, the pressure which has become negative rises rapidly. This cancels the pressure wave vibration. It is therefore possible to prevent accidental ejection of ink droplets and transfer early to the process according to the next print instruction. Because the non-ejection pulse C cancels the pressure wave vibration, this pulse causes no ink ejection.

Figure 5A:
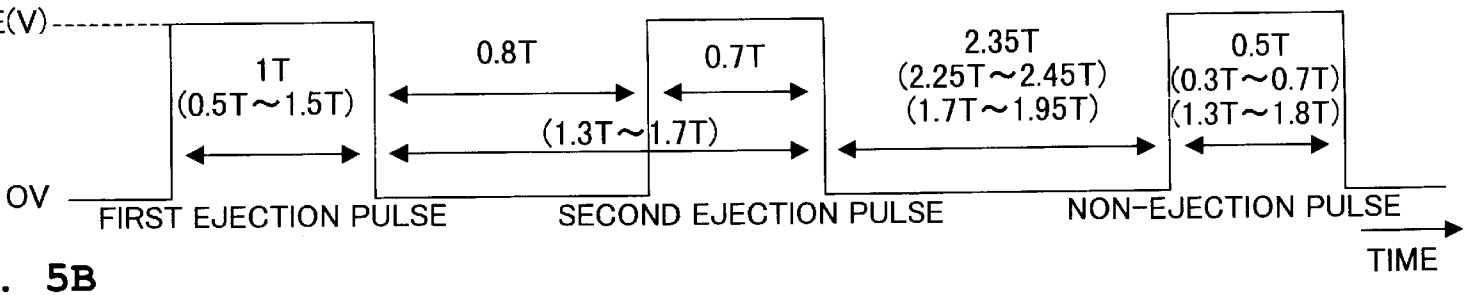
FIGS. 5A, 5B and 5C are illustrations showing drive waveforms output from the controller in different resolution modes.

FIG. 5A shows the widths Wa, Wb and Wc (as shown in FIG. 4) of the first and second ejection pulses and the non-ejection pulse, respectively, the interval I1 (as shown in FIG. 4) between the ejection pulses, and the interval I2 between the second ejection pulse and the non-ejection pulse. The width Wa ranges between 0.5T and 1.5T, and should preferably be 1T. The pulse interval I1 is 0.3T or longer, and should preferably be 0.8T. The width Wb is 0.3T or longer, and should preferably be 0.7T. The sum of the interval I1 and width Wb ranges between 1.3T and 1.7T. The interval I2 ranges between 1.7T and 1.95T or between 2.25T and 2.45T, and should preferably be 2.35T. The width Wc ranges between 0.3T and 0.7T or between 1.3T and 1.8T, and should preferably be 0.5T.

In the normal resolution mode, the two ejection pulses cause ejection of 40–45 picoliters of ink.

Figure 5B:
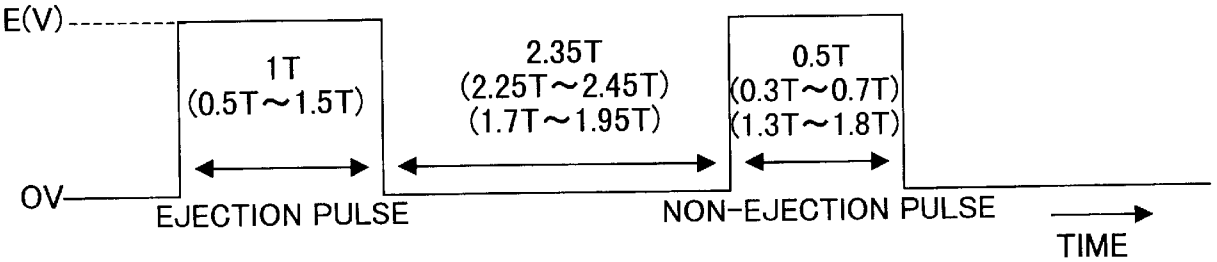

FIG. 5B shows an approximate drive waveform of voltage for application to the actuator walls 603*a*–603*h* in a first high resolution mode. This waveform includes an ejection pulse and a non-ejection pulse. The width of the ejection pulse ranges between 0.5T and 1.5T, and should preferably be 1T. The interval between the pulses ranges between 1.7T and 1.95T or between 2.25T and 2.45T, and should preferably be 2.35T. The width of the non-ejection pulse ranges between 0.3T and 0.7T or between 1.3T and 1.8T, and should preferably be 0.5T. The ejection pulse causes ejection of 20–25 picoliters of ink.

Figure 5C:
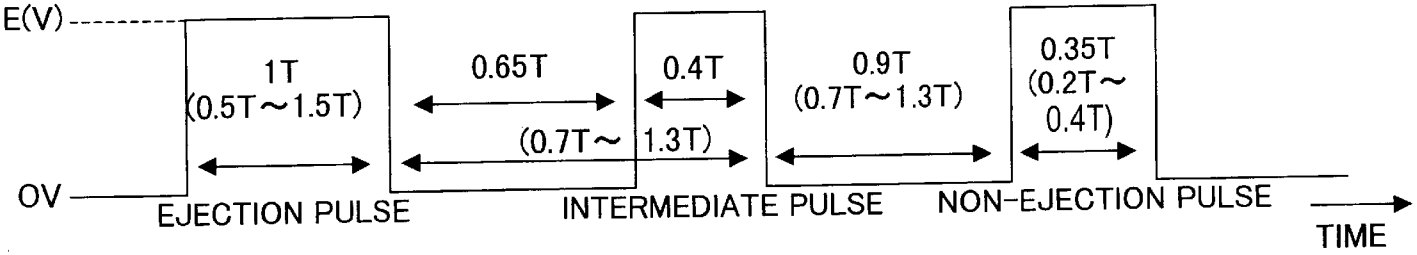

FIG. 5C shows an approximate drive waveform of voltage for application to the actuator walls 603*a*–603*h* in a second high resolution mode. This wave form includes an ejection pulse, an auxiliary or additional pulse and a non-ejection pulse. The peak values of the pulses are E volts.

As shown in FIG. 5C, the width of the ejection pulse ranges between 0.5T and 1.5T, and should preferably be 1T. If the voltage is applied to one pair of actuator walls 603*a*–603*h*, this pulse develops a high pressure in that portion of the associated channel 613 which is near to the associated nozzle 618. The pressure ejects an ink droplet from the channel 613.

The interval between the ejection pulse and the auxiliary pulse is 0.3T or longer, and should preferably be 0.65T. The width of the auxiliary pulse is 0.3T or longer, and should preferably be 0.4T. The sum of this interval and the width of the auxiliary pulse ranges between 0.7T and 1.3T.

The fall of the ejection pulse restores the deformed actuator walls to their original condition. The restoration develops a pressure in the channel 613. This pressure is added to the pressure in the channel 613 which has reversed to be positive. The addition quickly raises the positive pressure in the channel 613, ejecting the droplet. Thereafter, the positive pressure reverses to be negative, and then the negative pressure lowers.

The application of the auxiliary pulse after the ejection pulse deforms the actuator walls so as to lower the pressure in the channel 613 quickly. The lowered pressure pulls the meniscus in the nozzle 618 quickly toward the channel 613, drawing back a part of the droplet almost ejected from the nozzle 618. Consequently, the ejected droplet is smaller.

The interval between the auxiliary pulse and the non-ejection pulse ranges between 0.7T and 1.3T, and should preferably be 0.9T. The width of the non-ejection pulse ranges between 0.2T and 0.4T, and should preferably be 0.35T.

The non-ejection pulse cancels the pressure vibration in the channel 613. This makes it possible to prevent accidental ejection of ink droplets and transfer early to the process according to the next print instruction.

In the second high resolution mode, as stated above, the ejection pulse causes ejection of an ink droplet, and the auxiliary pulse draws back a part of the droplet. As a result, 10–15 picoliters of ink are ejected for one dot.

The ink used in these experiments has a viscosity of about 3 mPa·s and a surface tension of 30 mN/m at a temperature of 25 centigrade. The ratio L/V (=T) where,L is the length of the channels 613 and V is the sound velocity in the ink in the channels is 8 microseconds. During the experiments, the ink temperature was 25 centigrade and the ink viscosity was 3 mPa·s.

As shown in FIG. 6, also, the ejector ejects 40–45 picoliters of ink in the normal resolution mode, 20–25 picoliters of ink in the first high resolution mode and 10–15 picoliters of ink in the second high resolution mode. The volume of ink in the normal resolution mode is about 1.89 times as large as that in the first high resolution mode. The volume of ink in the second high resolution mode is about 0.56 of that in the first high resolution mode.

In the case of the conventional ejector which is shown as Comparative Experiment in FIG. 6, the ratio of the ink volume in the normal resolution mode to that in the high resolution mode is about 10/7. In the case of the embodiment of the invention, the ratio of the ink volume in the normal resolution mode to that in the first high resolution mode is approximately 2/1, and the ratio of the ink volume in the first high resolution mode to that in the second high resolution mode is approximately 2/1, also. This enables the difference in dot density between the resolution modes to be more distinct for better printing.

The invention is not limited to the embodiment, but various modifications may be made without departing from the spirit of the invention.

In the normal resolution mode, three or more ink droplets might, in place of two, be ejected for one dot. In this case as well, it is possible to form a thicker image.

The invention can also be applied to an apparatus for ejecting ink droplets by means of actuators made of material which is not piezo-electric. The invention can further be applied to a line printer, which includes an ink ejector fixed to the printer body.

The voltage output from the electric source 189 is constant. By using such an electric source of constant voltage, it is possible to simplify the structure and the control of the ejector very much.

What is claimed is:

1. An ink ejector comprising:

an ink jet head for ejecting ink, the head having an ink channel formed therein, which is filled with ink, the head further having an ink nozzle formed therein and communicating with the ink channel, the head including an actuator provided therein for changing the volume of the channel; and a controller for applying at least one ejection pulse of voltage to the actuator in accordance with a print instruction to control the actuator so as to eject ink from the channel through the nozzle;

the instruction including a setting of resolution with which the ejected ink forms an image;

the controller controlling the number of ejection pulses of voltage for ejecting ink droplets and a number of the ink droplets to be ejected for one dot in accordance with the setting of resolution.

2. The ink ejector defined in claim 1, wherein the controller increases the number of the ejection pulses of voltage to the actuator as the resolution is set as a lower resolution.

3. The ink ejector defined in claim 1, wherein the controller applies to the actuator two ejection pulses of voltage for printing one dot when the resolution is set as a first resolution, and the controller applies to the actuator a single ejection pulse of voltage for printing one dot when the resolution is set as a second resolution.

4. The ink ejector defined in claim 3, wherein the first resolution is a normal resolution, and the second resolution is a high resolution.

5. The ink ejector defined in claim 3, wherein the second resolution includes a high resolution and a super resolution, the controller applying to the actuator, in accordance with the super resolution, the single ejection pulse for ejecting an ink droplet and an auxiliary pulse of voltage for making the droplet smaller.

6. The ink ejector defined in claim 1, wherein, after applying the at least one ejection pulse to the actuator, the controller applies to the actuator a non-ejection pulse for varying the volume of the channel to cancel the pressure wave vibration in the channel.

7. The ink ejector defined in claim 5, wherein, after applying the auxiliary pulse to the actuator, the controller applies to the actuator a non-ejection pulse for varying the volume of the channel to cancel the pressure wave vibration in the channel.

8. The ink ejector defined in claim 7, wherein the non-ejection pulse has a width between 0.3T and 0.7T or between 1.3T and 1.8T where T is the one-way propagation time during which the pressure wave is propagated in the channel one way.

9. The ink ejector defined in claim 3, wherein the two ejection pulses for one dot are a first pulse and a second pulse following the first pulse;

the first pulse having a width between 0.5T and 1.5T where T is the one-way propagation time during which the pressure wave is propagated in the channel one way;

the interval between the first and second pulses being 0.3T or longer;

the second pulse having a width which is 0.3T or longer;

the sum of the interval and the width of the second pulse ranging between 1.3T and 1.7T.

10. The ink ejector defined in claim 9, wherein the width of the first pulse is 1.0T, the interval between the first and second pulses being 0.8T, the width of the second pulse being 0.7T.

11. The ink ejector defined in claim 3, wherein the single ejection pulse has a width between 0.5T and 1.5T where T is the one-way propagation time during which the pressure wave is propagated in the channel one way.

12. The ink ejector defined in claim 11, wherein, after applying the single ejection pulse to the actuator, the controller further applies to the actuator a non-ejection pulse for varying the volume of the channel to cancel the pressure wave vibration in the channel;

the interval between the ejection pulse and the non-ejection pulse ranging between 1.7T and 1.95T or between 2.25T and 2.45T.

13. The ink ejector defined in claim 12, wherein the non-ejection pulse has a width between 0.3T and 0.7T or between 1.3T and 1.8T.

14. The ink ejector defined in claim 5, wherein the single ejection pulse has a width between 0.5T and 1.5T where T is the one-way propagation time during which the pressure wave is propagated in the channel one way;

the interval between the ejection pulse and the auxiliary pulse being 0.3T or longer;

the auxiliary pulse having a width which is 0.3T or longer;

the sum of the interval and the width of the auxiliary pulse ranging between 1.3T and 1.7T.

15. The ink ejector defined in claim 14, wherein, after applying the auxiliary pulse to the actuator, the controller further applies to the actuator a non-ejection pulse for varying the volume of the channel to cancel the pressure wave vibration in the channel;

the interval between the auxiliary and non-ejection pulses ranging between 0.7T and 1.3T.

16. The ink ejector defined in claim 15, wherein the non-ejection pulse has a width between 0.3T and 0.7T or between 1.3T and 1.8T.

17. The ink ejector defined in claim 1, wherein the channel is formed between side walls made of piezoelectric material, the walls being the actuator.

18. The ink ejector defined in claim 1, wherein the controller includes a pulse control circuit.

19. The ink ejector defined in claim 18, wherein the pulse control circuit includes a data receiver, a memory, a processing unit and a pulse generator.

20. The ink ejector defined in claim 1, which is an ink jet printer.

* * * * *